US008496114B1

(12) United States Patent
Chu et al.

(10) Patent No.: US 8,496,114 B1
(45) Date of Patent: Jul. 30, 2013

(54) TRASH SEPARATOR

(75) Inventors: Youe-Tsyr Chu, Knoxville, TN (US); Johnathan W. Craps, Kodak, TN (US); Weichang Zhao, Oak Ridge, TN (US); Michael E. Galyon, Knoxville, TN (US); Hossein M. Ghorashi, Knoxville, TN (US)

(73) Assignee: Uster Technologies AG, Uster (CH)

( * ) Notice: Subject to any disclaimer, the term of this patent is extended or adjusted under 35 U.S.C. 154(b) by 0 days.

(21) Appl. No.: 13/523,219

(22) Filed: Jun. 14, 2012

(51) Int. Cl.
*B07B 4/00* (2006.01)
*B07B 7/00* (2006.01)
*D01B 3/00* (2006.01)

(52) U.S. Cl.
USPC ..... 209/139.1; 19/200

(58) Field of Classification Search
USPC ..... 19/200, 204, 66 CC, 100, 107, 108, 19/109, 112, 218, 233; 209/138, 139.1, 142
See application file for complete search history.

(56) References Cited

U.S. PATENT DOCUMENTS

| | | | | |
|---|---|---|---|---|
| 2,848,754 | A * | 8/1958 | Mayer, Jr. et al. | 209/142 |
| 4,382,857 | A * | 5/1983 | Laughlin | 209/23 |
| 5,270,787 | A | 12/1993 | Shofner et al. | |
| 5,321,496 | A | 6/1994 | Shofner et al. | |
| 5,410,401 | A | 4/1995 | Shofner et al. | |
| 5,414,900 | A * | 5/1995 | Gillum et al. | 19/55 R |
| 5,430,301 | A | 7/1995 | Shofner et al. | |
| 5,469,253 | A | 11/1995 | Shofner et al. | |
| 5,539,515 | A | 7/1996 | Shofner et al. | |
| 5,822,972 | A * | 10/1998 | Patelke et al. | 57/408 |
| 6,089,378 | A * | 7/2000 | Mascheretti et al. | 209/143 |
| 6,188,479 | B1 | 2/2001 | Shofner et al. | |
| 6,615,454 | B1 * | 9/2003 | Anthony | 19/41 |
| 6,615,455 | B1 * | 9/2003 | Pinto | 19/105 |
| 7,597,200 | B2 * | 10/2009 | Christensen | 209/295 |

FOREIGN PATENT DOCUMENTS

| | | |
|---|---|---|
| WO | 2011137553 | 11/2011 |
| WO | 2011137554 | 11/2011 |

* cited by examiner

*Primary Examiner* — David H Bollinger
(74) *Attorney, Agent, or Firm* — Luedeka Neely Group, P.C.; Rick Barnes

(57) ABSTRACT

An apparatus for processing a sample of fibers and trash, having a cylinder for receiving the sample. Pins extend from the surface of the cylinder and retain the fibers. A knife extends along the cylinder adjacent the pins, and removes the trash that is not retained by the pins. The trash is separated from the sample along a downward direction. A counter-flow of air in an upward direction is directed towards the cylinder, where the velocity is sufficient to blow the fibers that are not originally retained by the pins up toward the cylinder, and yet is insufficient to prevent gravity from pulling the trash downward.

20 Claims, 2 Drawing Sheets

TRASH SEPARATOR

FIELD

This invention relates to the field of fiber quality measurement. More particularly, this invention relates to separating non-fiber entities (such as trash) from fibers (such as cotton).

BACKGROUND

Natural and man-made fibers are routinely assessed for a variety of different properties, so as to grade the fiber samples. These properties include things such as fiber length, strength, color, moisture content, crimp, fineness, and non-fiber content. For example, measuring the properties of cotton fiber so as to provide a grade for the quality of the cotton is an important step in determining the value of the fibers.

Measuring the non-fiber content of a fiber sample is accomplished by separating the fibers in a fiber sample from as much of the non-fiber content (often generally referred to as trash) in the fiber sample as possible, and weighing or otherwise quantifying at least two of: (1) the original fiber sample, (2) the fibers that were separated from the original fiber sample, and (3) the trash that was separated from the original fiber sample. Typically, anything that is not the desired fibers themselves is considered non-fiber content, and designated as trash.

Unfortunately, prior art separators typically allow significant quantities of fibers to remain mixed in with the separated trash, thus making it difficult to determine the total trash content of the original fiber sample.

What is needed, therefore, is a system that reduces problems such as those described above, at least in part.

SUMMARY

The above and other needs are met by a separation apparatus for processing a fiber sample that includes both fibers and trash, and includes a separation cylinder rotating in a first direction and receiving the fiber sample. The separation cylinder has a cylindrical surface with a length extending along a longitudinal axis. Rigid protuberances with distal ends extend from the cylindrical surface. The protuberances selectively engage and retain the fibers of the fiber sample. A knife edge extends parallel to the longitudinal axis and along substantially the entire length of an underside of the separation cylinder, and is disposed adjacent the distal ends of the protuberances, for selectively removing from the fiber sample the trash that is not retained by the protuberances. The trash is thereby separated from the fiber sample along a substantially downward direction. A counter-flow of air moving at a first velocity in a substantially upward direction is directed towards the underside of the separation cylinder, where the first velocity is sufficient for the counter-flow of air to draw the fibers that are not retained by the protuberances up toward the separation cylinder, and yet is insufficient to prevent gravity from pulling the trash downward through the counter-flow of air. A collection surface receives the trash that falls downward through the counter-flow of air.

In various embodiments according to this aspect of the invention, a scale measures the weight of the trash received by the collection surface. In some embodiments a correction module, such as one including a camera, visually detects fibers on the collection surface and subtracts an estimated weight of the detected fibers from the weight of the trash. In some embodiments a feed roller is disposed adjacent the separation cylinder and in advance of the knife edge relative to the first direction of rotation of the separation cylinder. The feed roller rotates in the first direction and presents the fiber sample to the separation cylinder at a position where the feed roller tangential direction of motion is substantially opposite to the separation cylinder tangential direction of motion.

In some embodiments a vacuum source is disposed adjacent the separation cylinder and behind the knife edge relative to the first direction of rotation of the separation cylinder. The vacuum source draws an airflow away from the cylindrical surface of the separation cylinder and removes the fibers from the protuberances. In some embodiments the protuberances extend from the cylindrical surface of the separation cylinder at an angle that is inclined toward the first direction of rotation.

According to another aspect of the invention, there is described a method for processing a fiber sample that includes both fibers and trash. Fibers of the fiber sample are selectively engaged and retained with a pinned cylinder that is rotating in a first direction, and has a cylindrical surface with a length extending along a longitudinal axis, with rigid pins having distal ends extending from the cylindrical surface. Trash is selectively removed from the fiber sample that is not retained by the pins in a downward direction with a knife edge extending parallel to the longitudinal axis and along substantially the entire length of an underside of the pinned cylinder, and disposed adjacent the distal ends of the pins. The floating fibers and trash are contacted with a counter-flow of air moving at a first velocity in a substantially upward direction towards the underside of the pinned cylinder, the first velocity sufficient for the counter-flow of air to draw the fibers that are not retained by the pins up toward the pinned cylinder. The first velocity is insufficient to prevent gravity from pulling the trash downward through the counter-flow of air. The trash that has fallen downward through the counter-flow of air is collected on a collection surface.

In various embodiments according to this aspect of the invention, the weight of the trash collected on the collection surface is measured. In some embodiments the fibers on the collection surface are visually detected with a correction module and an estimated weight of the fibers is subtracted from the weight of the trash. In some embodiments the fiber sample is presented to the pinned cylinder with a feed roller that is disposed adjacent the pinned cylinder and in advance of the knife edge relative to the first direction of rotation of the pinned cylinder. The feed roller rotates in the first direction and at a position where a feed roller tangential direction of motion is substantially opposite to a pinned cylinder tangential direction of motion.

In some embodiments an air flow is drawn away from the cylindrical surface of the pinned cylinder and the fibers are removed from the pins with a vacuum source disposed adjacent the pinned cylinder and behind the knife edge relative to the first direction of rotation of the pinned cylinder.

DRAWINGS

Further advantages of the invention are apparent by reference to the detailed description when considered in conjunction with the figures, which are not to scale so as to more clearly show the details, wherein like reference numbers indicate like elements throughout the several views, and wherein.

DESCRIPTION

With reference now to the figures, there are described various embodiments of a trash separator 100, which is operable for separating trash particles 104 from fibers 106 in a fiber sample 102. The fiber sample 102 may take various forms. In one embodiment, the fiber sample 102 is cotton, but in other embodiments the fiber sample 102 is formed of other natural or man-made fibers, or combinations thereof. The fiber sample 102 includes both individual fibers 106 and trash particles 104.

Figure 1:
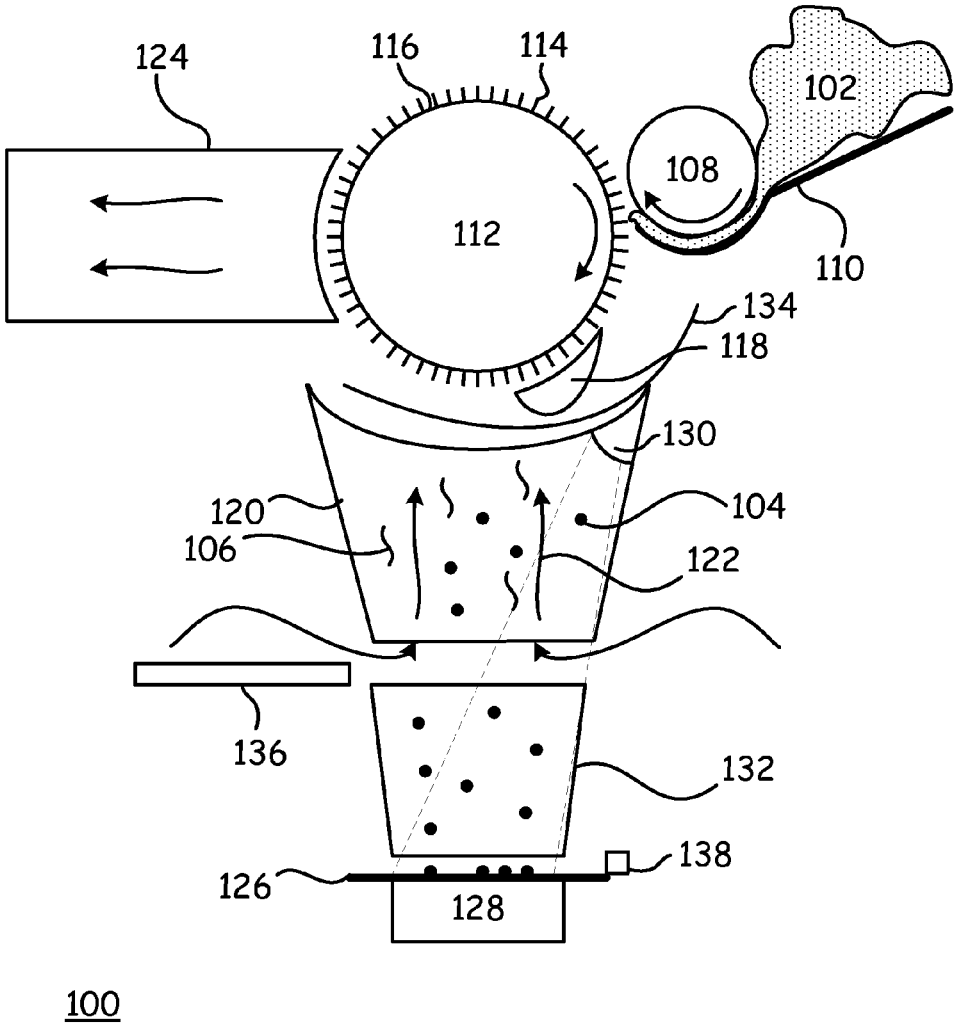
FIG. 1 depicts a trash separation apparatus from an end view of a separation cylinder according to an embodiment of the present disclosure.

In the embodiment depicted, the fiber sample 102 is presented to the trash separator 100 by feeding it between a feed roller 108 and a feed surface, or feed plate, 110. The feed roller 108 rotates in a first direction (such as indicated in FIG. 1) at a rotational rate of from about one rotation per minute to about four rotations per minute, such that the fiber sample 102 is pulled between the feed roller 108 and the feed surface 110. In the embodiment as depicted, the feed roller 108 rotates in a clockwise direction, pulling the fiber sample 102 toward a separation cylinder 112, which also rotates in the first direction (clockwise, as indicated in this embodiment as depicted) and at a rotational rate of from about one thousand rotations per minute to about two thousand rotations per minute.

In some embodiments the feed roller 108 is formed of a smooth-surfaced soft-matter coating (such as rubber) on a steel shaft, which adjusts to the varying thickness of the fiber sample 102 and retains the fiber sample 102 along the feed roller 108 axis, to prevent premature release of the fiber sample 102. The feed roller 108 is adjustable to make the gap between the feed roller 108 and the feed surface 110 larger or smaller, such as according to the varying thickness of the fiber sample 102. Therefore, the feed roller 108 holds the fiber sample 102 firmly while being combed by the separation cylinder 112, effectively reducing the generation of unopened fiber clumps that might be pulled out and thrown down.

Figure 2:
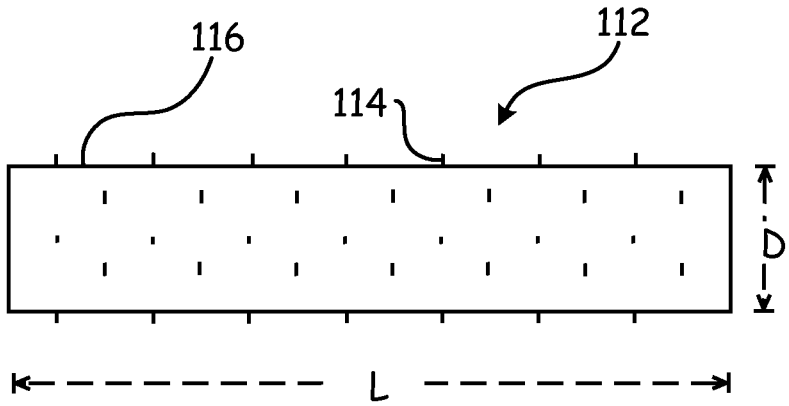
FIG. 2 is a front view of a separation cylinder according to an embodiment of the present invention.

FIG. 2 depicts a front view of the separation cylinder 112. In some embodiments the separation cylinder 112 has a length of from about 250 millimeters to about 800 millimeters, and a diameter of from about 100 millimeters to about 300 millimeters. In some embodiments the feed roller 108 has a length that is substantially equal to that of the separation cylinder 112, and a diameter of from about thirty-seven millimeters to about seventy-five millimeters.

The feed roller 108 and the separation cylinder 112 are disposed adjacent one another at a first position, at which the tangential direction of motion of the feed roller 108 and the tangential direction of motion of the separation cylinder 112 are substantially opposite one another. The tangential direction of motion is defined as the direction of travel of a point on a surface of a rotating body. The feed surface 110 keeps the fiber sample 102 engaged by the feed roller 108 until the fiber sample 102 is disposed at substantially the first position (as opposed to releasing it much earlier), at which position the fiber sample 102 is contacted by the separation cylinder 112, which is moving in the opposite tangential direction. These opposing directions of motion between the feed roller 108 and the separation cylinder 112 produce a severe sheering force on the fiber sample 102 that pulls it apart.

As the fiber sample 102 separates, the fibers 106 tend to be predominantly engaged and retained by the protuberances 114 of the separation cylinder 112, while the trash particles 104 of the fiber sample 102 tend to remain predominantly unengaged by the protuberances 114. Some of the trash 104 is separated from the fibers 106 at this point, as the protuberances 114 tend to bat the trash 104 in a downward direction and away from the fibers 106 that are engaged by the protuberances 114. In some embodiments the protuberances 114 are saw-tooth structures, and in other embodiment the protuberances 114 are pins. In some embodiments, a combination of saw teeth and pins comprise the protuberances 114.

Figure 3:
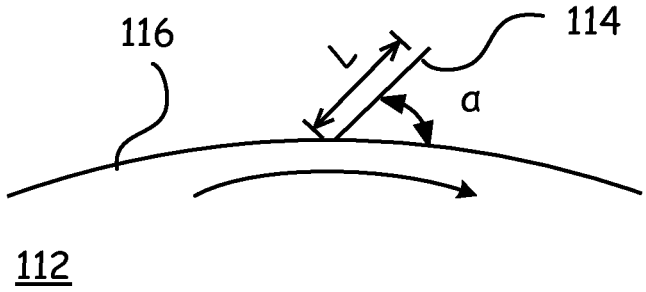
FIG. 3 is a side view of a separation cylinder and protuberances according to an embodiment of the present invention.

In some embodiments, and as depicted in more detail in FIG. 3, the protuberances 114 protrude from the cylindrical surface 116 of the separation cylinder 112 at an angle $\alpha$ in relation to the surface 116 of the separation cylinder 112. The angle $\alpha$ is from about fifty degrees to about ninety degrees, and leans into the direction of rotation of the separation cylinder 112. The length of the protuberances is from about two millimeters to about four millimeters.

In some embodiments the protuberances 114 are evenly spaced-apart across the surface 116 of the separation cylinder 112. In some embodiments the spacing of the protuberances 114 across the surface 116 depends upon the type of fiber sample 102 being tested. For example, for one type of fiber sample 102 it may be desirable to place the protuberances 114 relatively further apart, while with another fiber sample 102 it may be desirable to place the protuberances 114 relatively closer together.

A knife 118 is disposed adjacent the separation cylinder 112, such that the knife 118 extends parallel to the longitudinal axis and along substantially the entire length of the separation cylinder 112. The knife 118 is positioned such that any trash 104 that is not entrained within the protuberances 114 is predominantly removed from the fibers 106 that are entrained within the protuberances 114, and is deflected in a downward direction towards a counter-flow chamber 120. In some embodiments, the edge of the knife 118 is disposed very close to the ends of the protuberances 114. In some embodiments the edge of the knife 118 is straight and does not interdigitated the protuberances 114.

Some embodiments include a lint deflector 134, such as made of parallel and bent metal tines disposed along the direction of rotation of the separation cylinder 112, which help prevent large clumps of material from falling. The lint deflector 134 works as a filter or screen to help prevent clumps of fibers 106 from dropping to the trash collection surface 126, but let the trash 104 to pass through. The tines of the lint deflector 134 in one embodiment are parallel to each other and bent along the direction of the air flow. The tines in one embodiment deflect the fiber clumps with a size larger than about six millimeters without catching individual fibers 106. The ends of the wires of the lint deflector 134 are open near the vacuum source 124 so that material that is caught by the lint deflector 134 is not retained by the lint deflector 134, but instead will be drawn off by the vacuum source 124.

The counter-flow chamber 120 provides an upward-directed airflow 122 that enters the counter-flow chamber 120 at the bottom of the counter-flow chamber 120 (as indicated in FIG. 1), such that the airflow 122 is in an upward direction and substantially opposite to the direction of travel of the falling trash particles 104 and the few fibers 106 that were not originally engaged by the protuberances 114. The purpose of the airflow 122, which in some embodiments is generated by the vacuum source 124 and air flow from the rotating separation cylinder 112, is to blow such non-engaged fibers 106 back up toward the bottom of the separation cylinder 112, such that they engage with the protuberances 114, or are carried by the air flow from the rotating separation cylinder 112 to the vacuum source 124, and do not continue down through the counter-flow chamber 120. The upwardly directed airflow 122 changes the trajectory of the falling fibers 106 by about 180 degrees, whereas an airflow in any other direction, such as a cross-flow of air, would only change the fiber 106 trajectory by no more than about ninety degrees.

To accomplish this, the airflow 122 moves at a first velocity such that any fibers 106 that attain the counter-flow chamber 120 are generally lofted upwards by the airflow 122 toward the separation cylinder 112. However, the first velocity of the airflow 122 is generally insufficient to prevent gravity or other forces, such as momentum, from drawing the trash particles 104 downward through the counter-flow chamber 120.

In some embodiments the airflow 122 through the counter-flow chamber 120 is adjustable from about twenty-five meters per minute to about sixty meters per minute, such as depending upon the type of fiber sample 102 being tested. For example, when a heavier fiber 106 is being tested, then the airflow 122 may flow through the counter-flow chamber 120 at a relatively faster rate, to reduce the occurrence of the heavier fibers falling through the counter-flow chamber 120. On the other hand, when a lighter fiber 104 is being tested, the airflow 122 may flow through the counter-flow chamber 120 at a relatively slower rate, to reduce the occurrence of lighter trash particles being drawn upwards toward the separation cylinder 112 and the vacuum source 124.

In some embodiments, a vacuum source 124 is disposed adjacent the separation cylinder 112. In some embodiments, the vacuum source 124 is controlled to maintain a stable air flow 122. The vacuum source 124 draws an airflow away from the separation cylinder 112, and removes the fibers 106 that were engaged by the protuberances 114 from the separation cylinder 112. The vacuum source 124 is disposed after the knife 118, relative to the direction of rotation of the separation cylinder 112, as depicted. In some embodiments the vacuum source 124 creates the air flow 122.

In the embodiment as depicted, the trash particles 104 that fall down through the counter-flow chamber 120 then fall through a stilling chamber 132 in which the air is substantially stagnant, in that there is no forced air flow in any direction. The trash particles 104 fall down through the chamber 132 and onto a collection surface 126. Because of the counter-flow of air 122, few or no fibers 106 attain the collection surface 126. Thus, the apparatus 100 achieves a highly successful separation of the fibers 106 and the trash 104 of the fiber sample 102. Some embodiments include a trash vacuum wiper bar 138 to remove trash 104 (and fibers 106, as needed) from the tray 126.

The counter-flow chamber 120 and stilling chamber 132 have an opening between them that allows air to enter the counter-flow chamber 120 and flow upward to the vacuum source 124. The counter-flow of air 122 works as a filter for the freely flying loose fibers 106 to prevent them from dropping to the trash collection surface 126.

In some embodiments, the trash content of the fiber sample 102 is determined by measuring the mass of the fiber sample 102 before it is processed through the trash separator 100, and then measuring the mass of the trash particles 104, such as by weighing the collection surface 126 and the trash 104 disposed thereon. As desired, the trash 104 content as a percentage of the total weight of the fiber sample 102 can be calculated. In some embodiments, the mass of the fibers 106 that are eventually drawn off by the vacuum source 124 can also be measured and used in similar calculations. In some embodiments, an air curtain plate 136 is disposed between the counter-flow chamber 120 and the stilling chamber 132 or between the stilling chamber 132 and the collection surface 126, and is used to seal off the collection surface 126 to minimize air currents 122 when the trash 104 is being weighed.

Some fibers 106 still might attain the collection surface 126. In some embodiments, these fibers 106 are manually removed before weighing the collection surface 126. In other embodiments, the weight of the fibers 106 on the collection surface is determined with a correction module 130 that visually detects the fibers 106 on the collection surface 126, and estimates the weight of the detected fibers 106, and subtracts that estimated weight from the weight of the collection surface 126, thus yielding the weight of the trash particles 104.

The foregoing description of embodiments for this invention has been presented for purposes of illustration and description. It is not intended to be exhaustive or to limit the invention to the precise form disclosed. Obvious modifications or variations are possible in light of the above teachings. The embodiments are chosen and described in an effort to provide illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

The invention claimed is:

1. A separation apparatus for processing a fiber sample that includes both fibers and trash, the separation apparatus comprising:

a pinned cylinder for rotating in a first direction and receiving the fiber sample, the pinned cylinder having a cylindrical surface with a length extending along a longitudinal axis, and rigid pins having distal ends extending from the cylindrical surface, the pins for selectively engaging and retaining the fibers of the fiber sample, a knife edge extending parallel to the longitudinal axis and along substantially the entire length of an underside of the pinned cylinder, and disposed adjacent the distal ends of the pins, for selectively removing from the fiber sample the trash that is not retained by the pins, the trash thereby separating from the fiber sample along a substantially downward direction, a counter-flow of air moving at a first velocity in a substantially upward direction towards the underside of the pinned cylinder, the first velocity sufficient for the counter-flow of air to blow the fibers that are not originally retained by the pins up toward the bottom of the pinned cylinder and thereby engaging the fibers with the pinned cylinder, and the first velocity insufficient to prevent gravity from pulling the trash downward through the counter-flow of air, and a collection surface for receiving the trash that has fallen downward through the counter-flow of air.

2. The separation apparatus of claim 1, further comprising a scale for measuring the weight of the trash received by the collection surface.

3. The separation apparatus of claim 2, further comprising a correction module for visually detecting fibers on the collection surface and subtracting an estimated weight of the detected fibers from the weight of the trash.

4. The separation apparatus of claim 1, further comprising a feed roller disposed adjacent the pinned cylinder and in advance of the knife edge relative to the first direction of rotation of the pinned cylinder, the feed roller for rotating in the first direction and presenting the fiber sample to the pinned cylinder at a position where a feed roller tangential direction of motion is substantially opposite to a pinned cylinder tangential direction of motion.

5. The separation apparatus of claim 1, further comprising a vacuum source disposed adjacent the pinned cylinder and behind the knife edge relative to the first direction of rotation of the pinned cylinder, the vacuum source for drawing an air flow away from the cylindrical surface of the pinned cylinder and removing the fibers from the pins.

6. The separation apparatus of claim 5, further comprising a lint deflector made of bent and parallel tines disposed along the pinned cylinder in the direction of rotation to prevent clumps of the fiber sample from falling to the collection surface and to guide clumps along the tines and back to the pinned cylinder and vacuum source.

7. The separation apparatus of claim 1, wherein the pins extend from the cylindrical surface of the pinned cylinder at an angle that is inclined toward the first direction of rotation.

8. The separation apparatus of claim 1, wherein the protrusions comprise saw teeth.

9. The separation apparatus of claim 1, wherein the protrusions comprise pins.

10. A separation apparatus for processing a fiber sample that includes both fibers and trash, the separation apparatus comprising:

a separation cylinder for rotating in a first direction and receiving the fiber sample, the separation cylinder having a cylindrical surface with a length extending along a longitudinal axis, and rigid protrusions having distal ends extending from the cylindrical surface, the protrusions for selectively engaging and retaining the fibers of the fiber sample, a knife edge extending parallel to the longitudinal axis and along substantially the entire length of an underside of the separation cylinder, and disposed adjacent the distal ends of the protrusions, for selectively removing from the fiber sample the trash that is not retained by the protrusions, the trash thereby separating from the fiber sample along a substantially downward direction, a counter-flow of air moving at a first velocity in a substantially upward direction towards the underside of the separation cylinder, the first velocity sufficient for the counter-flow of air to blow the fibers that are not originally retained by the protrusions up toward the bottom of the separation cylinder and thereby engaging the fibers with the separation cylinder, and the first velocity insufficient to prevent gravity from pulling the trash downward through the counter-flow of air, and a collection surface for receiving the trash that has fallen downward through the counter-flow of air.

11. The separation apparatus of claim 10, further comprising a scale for measuring the weight of the trash received by the collection surface.

12. The separation apparatus of claim 11, further comprising a correction module for visually detecting fibers on the collection surface and subtracting an estimated weight of the detected fibers from the weight of the trash.

13. The separation apparatus of claim 10, further comprising a feed roller disposed adjacent the separation cylinder and in advance of the knife edge relative to the first direction of rotation of the separation cylinder, the feed roller for rotating in the first direction and presenting the fiber sample to the separation cylinder at a position where a feed roller tangential direction of motion is substantially opposite to a separation cylinder tangential direction of motion.

14. The separation apparatus of claim 10, further comprising a vacuum source disposed adjacent the separation cylinder and behind the knife edge relative to the first direction of rotation of the separation cylinder, the vacuum source for drawing an air flow away from the cylindrical surface of the separation cylinder and removing the fibers from the protrusions.

15. The separation apparatus of claim 14, further comprising a lint deflector made of bent and parallel tines disposed along the separation cylinder in the direction of rotation to prevent clumps of the fiber sample from falling to the collection surface and to guide clumps along the tines and back to the separation cylinder and vacuum source.

16. The separation apparatus of claim 10, wherein the protrusions extend from the cylindrical surface of the separation cylinder at an angle that is inclined toward the first direction of rotation.

17. A method for processing a fiber sample that includes both fibers and trash, the method comprising the steps of:

selectively engaging and retaining fibers of the fiber sample with a separation cylinder, the separation cylinder rotating in a first direction and having a cylindrical surface with a length extending along a longitudinal axis, and rigid pins having distal ends extending from the cylindrical surface, selectively removing from the fiber sample trash that is not retained by the pins in a downward direction with a knife edge extending parallel to the longitudinal axis and along substantially the entire length of an underside of the separation cylinder, and disposed adjacent the distal ends of the pins, contacting the fibers and trash with a counter-flow of air moving at a first velocity in a substantially upward direction towards the underside of the separation cylinder, the first velocity sufficient for the counter-flow of air to blow the fibers that are not originally retained by the pins up toward the bottom of the separation cylinder and thereby engaging the fibers with the separation cylinder, and the first velocity insufficient to prevent gravity from pulling the trash downward through the counter-flow of air, and collecting on a collection surface the trash that has fallen downward through the counter-flow of air.

18. The method of claim 17, further comprising measuring the weight of the trash collected on the collection surface.

19. The method of claim 18, further comprising:

visually detecting fibers on the collection surface with a correction module, and subtracting an estimated weight of the fibers from the weight of the trash.

20. The method of claim 17, further comprising presenting the fiber sample to the separation cylinder with a feed roller that is disposed adjacent the separation cylinder and in advance of the knife edge relative to the first direction of rotation of the separation cylinder, the feed roller rotating in the first direction and at a position where a feed roller tangential direction of motion is substantially opposite to a separation cylinder tangential direction of motion.

* * * * *